US009414678B2

(12) United States Patent
Bennie et al.

(10) Patent No.: US 9,414,678 B2
(45) Date of Patent: Aug. 16, 2016

(54) SHELF SYSTEM

(71) Applicant: Steelcase Inc., Grand Rapids, MI (US)

(72) Inventors: William Burr Bennie, Rockford, MI (US); John Allen, Lowell, MI (US); Daniel George Parker, Grand Rapids, MI (US); Bradley D. Youngs, Byron Center, MI (US); Alvin Berdette Larson, Jenison, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/268,262

(22) Filed: May 2, 2014

(65) Prior Publication Data

US 2015/0313359 A1 Nov. 5, 2015

(51) Int. Cl.

| | |
|---|---|
| ***A47B 96/02*** | (2006.01) |
| ***A47B 47/00*** | (2006.01) |
| ***A47B 47/02*** | (2006.01) |
| *A47B 57/20* | (2006.01) |

(52) U.S. Cl.

CPC ..... *A47B 96/021* (2013.01); *A47B 47/0066* (2013.01); *A47B 47/025* (2013.01); *A47B 57/20* (2013.01)

(58) Field of Classification Search

CPC ..... A47B 96/021; A47B 47/0066; A47B 87/0246; A47B 96/02; A47B 47/02; A47B 47/021; A47B 47/042; A47B 57/30; A47B 63/00; A47B 47/00; A47B 47/025; A47B 57/20; A47F 5/0043; A47F 5/0018; A47F 5/00; A47F 5/08; A47F 5/16

USPC ..... 211/153, 90.01, 134, 119.003, 135; 108/107, 193, 147.16; 312/265.5, 351, 312/108

See application file for complete search history.

(56) References Cited

U.S. PATENT DOCUMENTS

| | | | | | |
|---|---|---|---|---|---|
| 1,491,678 | A | | 4/1924 | Dabney | |
| 1,614,719 | A | | 1/1927 | Dabney | |
| 2,685,372 | A | * | 8/1954 | Palaith | A47B 96/025 211/135 |
| 2,790,559 | A | * | 4/1957 | Stephenson | A47B 96/028 108/108 |
| 3,129,677 | A | * | 4/1964 | Zarley | A47B 65/00 108/107 |
| 3,143,980 | A | * | 8/1964 | Sperring | A47B 96/066 108/108 |
| 3,167,037 | A | * | 1/1965 | Mapson | A47B 57/045 108/108 |
| 3,323,656 | A | * | 6/1967 | Weiss | A47B 96/021 108/152 |
| 3,601,462 | A | * | 8/1971 | Fenwick | E06B 3/4663 312/139.2 |
| 3,613,604 | A | | 10/1971 | Butler | |
| 3,680,938 | A | * | 8/1972 | Ohlsson | B42F 15/0088 211/187 |
| 3,703,325 | A | * | 11/1972 | Schnarr | A47B 63/00 312/307 |
| 3,827,377 | A | * | 8/1974 | Aughtry, Jr. | A47F 5/103 108/108 |
| 3,845,864 | A | | 11/1974 | Heinrich | |
| 4,139,247 | A | | 2/1979 | Karashima | |
| 4,240,557 | A | | 12/1980 | Dickens | |
| D265,561 | S | * | 7/1982 | Cottrell | D14/448 |
| 4,526,110 | A | | 7/1985 | Franz | |
| 4,785,742 | A | | 11/1988 | Esslinger | |
| 4,826,265 | A | * | 5/1989 | Hockenberry | A47B 81/00 108/901 |
| 5,008,779 | A | * | 4/1991 | Salmon | H05K 7/1425 211/41.17 |

(Continued)

*Primary Examiner* — Joshua Rodden
*Assistant Examiner* — Hiwot Tefera
(74) *Attorney, Agent, or Firm* — Price Heneveld LLP

(57) ABSTRACT

A shelf has a front edge with reduced vertical dimension whereby the shelf appears to be very thin when viewed from the front. The shelf includes opposite end portions that are configured to engage spaced apart vertical support surfaces to thereby support the shelf. The shelf includes a generally planar upper portion and a lower portion structure having a generally planar horizontal rear portion and an angled front portion that extends forwardly and upwardly to provide a thin front edge of the shelf.

24 Claims, 20 Drawing Sheets

(56) References Cited

U.S. PATENT DOCUMENTS

| | | | | | |
|---|---|---|---|---|---|
| 5,188,246 | A | | 2/1993 | Maxworthy | |
| 5,365,857 | A | * | 11/1994 | Kilpatrick | B65D 19/0012 108/51.3 |
| 5,626,084 | A | | 5/1997 | Kelly et al. | |
| 5,799,803 | A | * | 9/1998 | Muller | A47F 5/0043 108/108 |
| 5,893,470 | A | * | 4/1999 | Peggs | A47B 96/028 211/90.01 |
| D416,721 | S | | 11/1999 | Schacht et al. | |
| D417,572 | S | | 12/1999 | Schacht et al. | |
| 6,076,308 | A | | 6/2000 | Lyon et al. | |
| 6,135,033 | A | * | 10/2000 | Deferrari | A47F 5/116 108/165 |
| 6,371,035 | B1 | | 4/2002 | Schiedegger et al. | |
| 6,488,347 | B1 | | 12/2002 | Bienick | |
| D483,968 | S | | 12/2003 | King et al. | |
| 6,837,467 | B2 | | 1/2005 | Cheng | |
| 7,494,019 | B2 | | 2/2009 | Kessell et al. | |
| D609,510 | S | | 2/2010 | Stafford et al. | |
| 8,172,096 | B2 | * | 5/2012 | Van De Steen | A47B 96/02 211/119.003 |
| 2005/0184630 | A1 | * | 8/2005 | Bonanno | A47B 57/32 312/408 |
| 2007/0221103 | A1 | * | 9/2007 | Trausch | A47B 57/045 108/108 |
| 2009/0026161 | A1 | * | 1/2009 | Scriba | A47F 5/01 211/144 |

* cited by examiner

SHELF SYSTEM

BACKGROUND OF THE INVENTION

Various types of shelf systems have been developed for storing items. Known shelf systems may include cantilevered supports that engage vertical rails to support the shelves. Other shelves are configured to be supported between vertical wall surfaces on pins or other supports. However, known shelving systems may suffer from various drawbacks.

SUMMARY OF THE INVENTION

One aspect of the present invention is a shelf having a relatively thin front edge with a very small vertical dimension. The thin front edge causes the shelf to appear as if it has little or no thickness when viewed from a normal range in front/above the shelf.

The shelf includes opposite end portions that are configured to engage pins or other supports disposed on spaced apart vertical support surfaces to thereby support the shelf. The shelf includes a metal shelf structure having a generally tubular construction including an upper sheet portion having a generally planar horizontal portion defining front and rear edges. The shelf structure further includes a lower sheet portion and front and rear portions that interconnect the upper and lower sheet portions to define an interior space. The opposite end portions of the shelf structure extend between front and rear corners of the shelf. Each end portion of the shelf includes front and rear support features that are configured to engage horizontal pins or other supports extending from vertical support surfaces adjacent the opposite end portions of the shelf structure to support the shelf structure adjacent the front and rear corners thereof. The lower sheet portion of the metal shelf structure includes a generally planar horizontal rear portion that is spaced apart from the planar horizontal upper sheet portion to define a substantially uniform vertical first dimension. The lower sheet portion further includes a generally planar angled front portion that intersects the rear portion along an intersection or fold line. The angled front portion extends forwardly and upwardly from the rear portion to the front portion of the shelf structure. A front portion of the shelf structure thereby tapers to provide a significantly reduced vertical dimension at the front edge portion of the shelf structure relative to the vertical first dimension.

Another aspect of the present invention is a shelf having opposite end portions that are configured to engage spaced apart vertical supports to thereby support the shelf. The shelf includes a generally planar top panel having a front edge, a rear edge, and side edges extending between the front and rear edges. The shelf also includes a bottom panel having a generally planar rear portion that is vertically spaced apart from the top panel to define a first vertical dimension. The bottom panel further includes a generally planar angled front portion that extends forwardly and upwardly from the rear portion. The angled front portion is joined to the top panel along the front edge thereof to define a front shelf edge having a second vertical dimension that is substantially smaller than the first vertical dimension. Each opposite end of the shelf includes at least two downwardly facing support surfaces that are open outwardly away from the opposite end portions to receive support members such as horizontal pins extending from the vertical supports.

Another aspect of the present invention is a storage system including a pair of spaced apart upright panels having generally vertical inner sides that face one another. At least two supports extend inwardly from each vertical inner side of the upright panels. The storage system further includes a shelf having front and rear edges and opposite ends engaging the supports to support the shelf. The shelf includes a planar horizontal upper surface and a lower surface having a planar horizontal rear portion and an angled forward portion that extends forwardly and upwardly from the planar horizontal rear portion such that the shelf has a reduced thickness along the front edge of the planar horizontal upper surface.

Another aspect of the present invention is the ornamental design for a shelf as shown and described in the drawings.

These and other features, advantages, and objects of the present invention will be further understood and appreciated by those skilled in the art by reference to the following specification, claims, and appended drawings.

DETAILED DESCRIPTION

Figure 1:
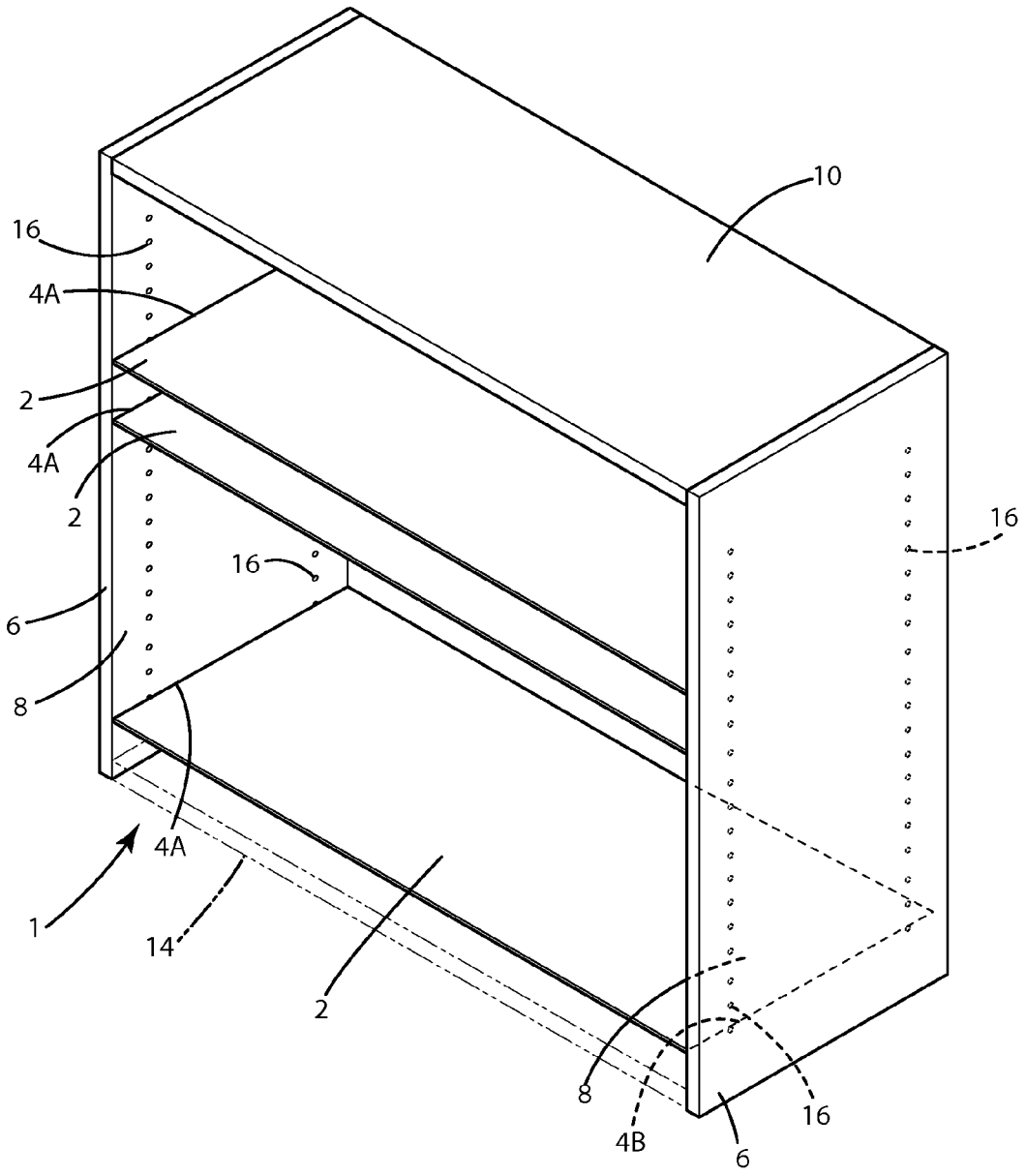
FIG. 1 is an isometric view of a shelf system including a plurality of shelves according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The left-hand side elevational views are mirror images of the left-hand side elevational views of FIGS. 8, 15, 22, and 28.

Figure 2:
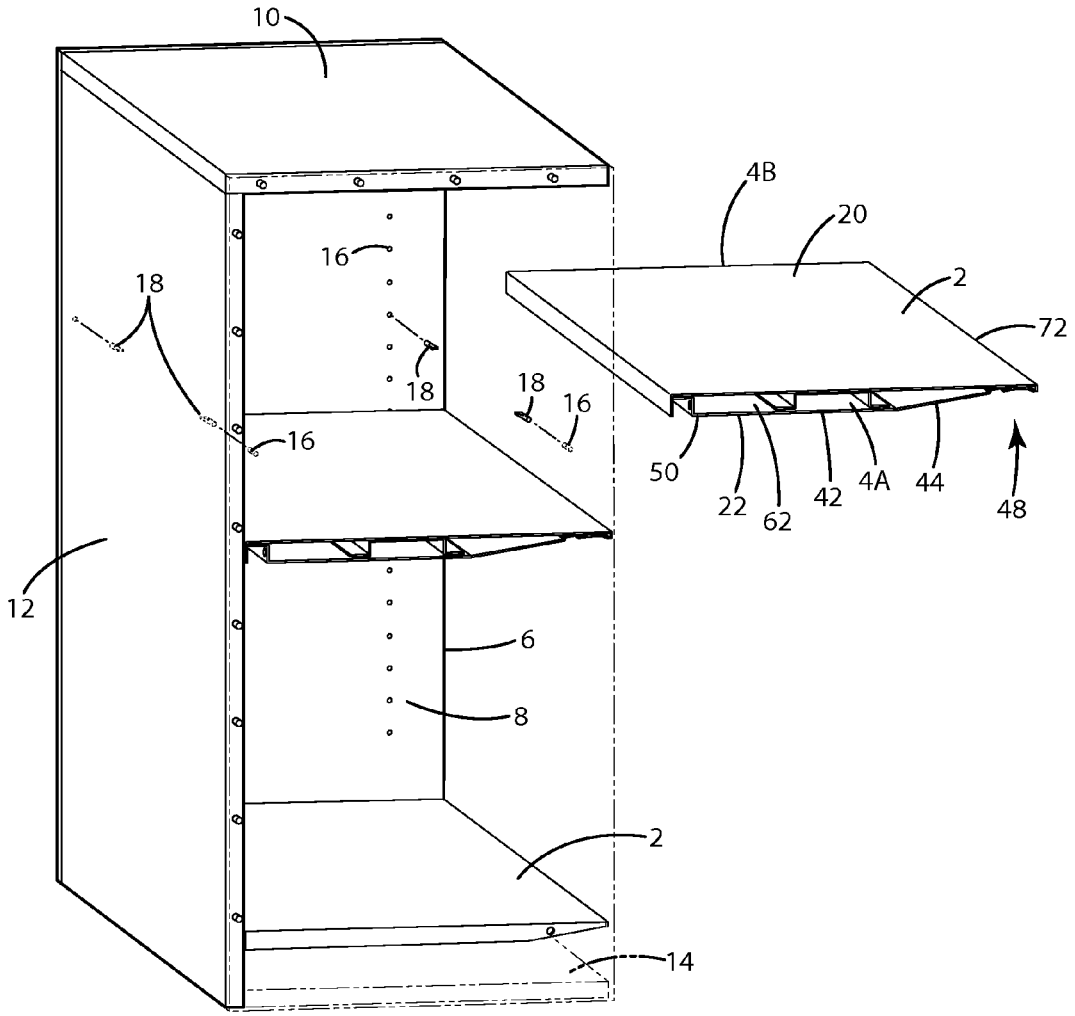
FIG. 2 is a partially exploded isometric view of the shelf system of FIG. 1.

With reference to FIGS. 1 and 2, a shelf system 1 according to the present invention includes one or more shelves 2 having opposite ends 4A, 4B that engage pins 18 disposed on upright members 6. The upright members 6 may comprise panels or other structures having vertical inner surfaces 8. The inner surfaces 8 of upright members 6 may include vertical rows of openings 16 that receive supports such as pins 18 to support the shelves 2. The upright members 6 may be interconnected by an upper panel 10, rear panel 12 and a lower panel 14 to define a cabinet structure. However, it will be understood that the upright members 6 could comprise architectural walls, partition panels, or other vertical support structures of the type that include pins 18 or other suitable supports.

Figure 3:
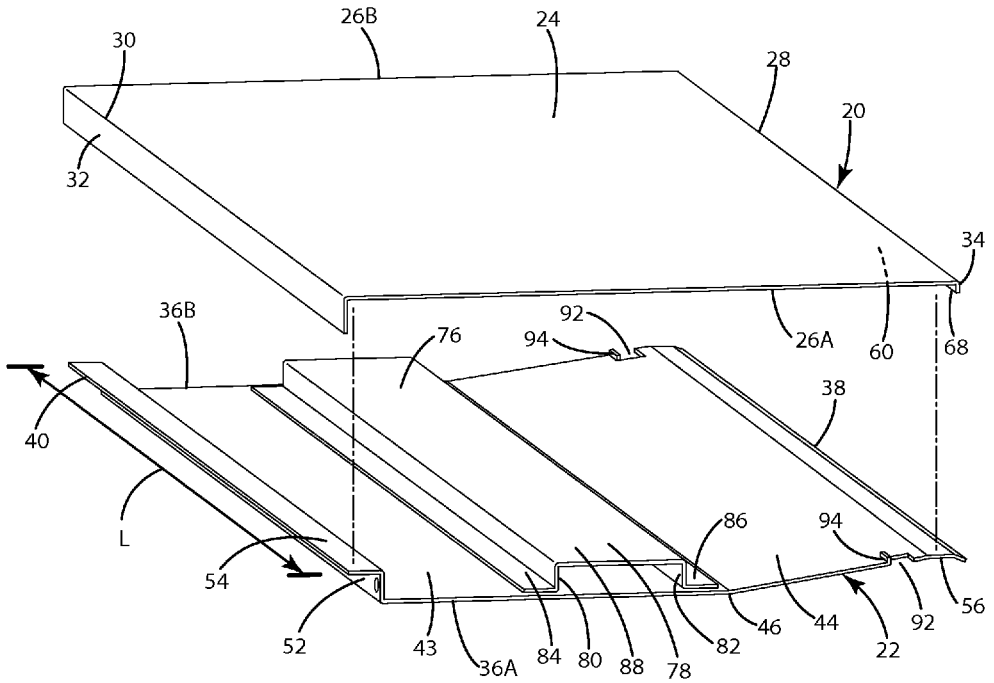
FIG. 3 is an exploded isometric view of a shelf.

With further reference to FIG. 3, each shelf 2 may include an upper member 20 and a lower member 22. The upper and lower members 20 and 22 may comprise two separate pieces of sheet metal such as mild steel or other suitable material that are welded together, or the upper and lower members may comprise a single piece of material that is extruded, roll-formed, molded, or otherwise formed from metal, polymer, or other suitable material. The upper member 20 includes a generally planar upper portion 24, opposite side edges 26A and 26B, a front edge 28, and a rear edge 30. The upper member 20 also includes a downwardly extending rear flange 32 and a downwardly extending front flange 34.

The lower member 22 includes opposite side edges 36A and 36B, a front edge 38, and a rear edge 40. The lower member 22 also includes a generally planar rear portion 42 and an angled front portion 44 that is joined with the planar rear portion 42 along a fold line or intersection 46. The angled front portion 44 extends upwardly and forwardly such that a front portion 48 (see also FIG. 4) of the shelf 2 has a reduced vertical dimension relative to a rear portion 50 of the shelf 2. Lower member 22 also includes a rear flange 52 that extends upwardly, and an edge flange 54 that extends horizontally from the rear flange 52. When assembled, the edge flange 54 may be spot welded to the upper member 20 to form a rear channel 96 (FIG. 5).

Figure 4:
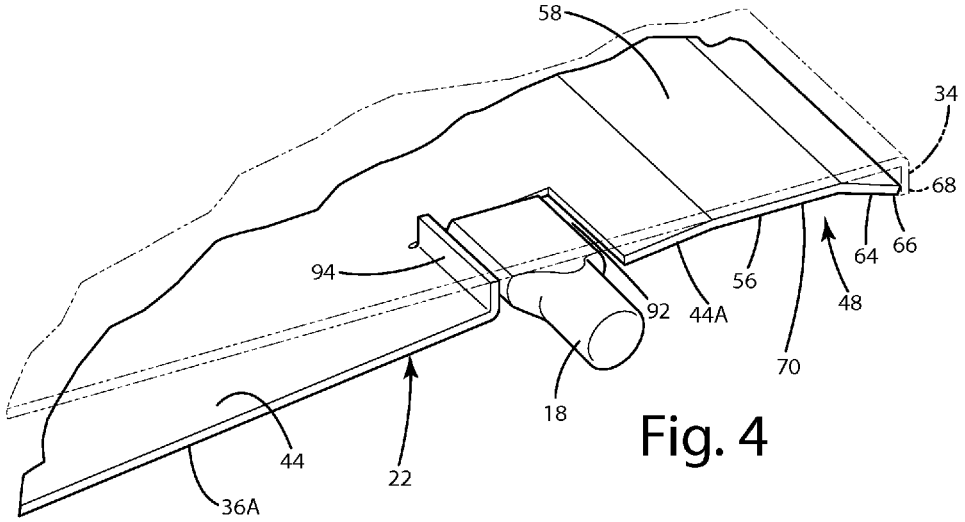
FIG. 4 is a partially fragmentary isometric view of a portion of the shelf of FIG. 3.

With further reference to FIG. 4, the lower member 22 includes a horizontal front portion 56 having an upper surface 58 that abuts a lower surface 60 (see also FIG. 3) of upper member 20 when upper and lower members 20 and 22 are assembled. The horizontal portion 56 of lower member 22 may be spot welded to upper member 20 such that the shelf 2 has a generally tubular construction defining an interior space 62 (FIG. 5). The opposite ends 4A and 4B of the shelves 2 are preferably open. However, the ends 4A and 4B may be closed off by flanges (not shown) formed from upper member 20 or lower member 22. Alternatively, end caps or covers (not shown) may also be utilized to close off the ends 4A and 4B of the shelves 2.

Referring again to FIG. 4, lower member 22 further includes a front edge flange 64 that extends downwardly and forwardly from the horizontal portion 56. Front edge 66 of flange 64 is disposed directly adjacent and behind lower edge 68 of downwardly extending front flange 34 of upper member 20. A front portion 44A of angled portion 44 of lower member 22, horizontal portion 56 of lower member 22, and front edge flange 64 of lower member 22 together define a downwardly opening shallow channel 70 that extends along front edge 72 of shelf 2.

Figure 5:
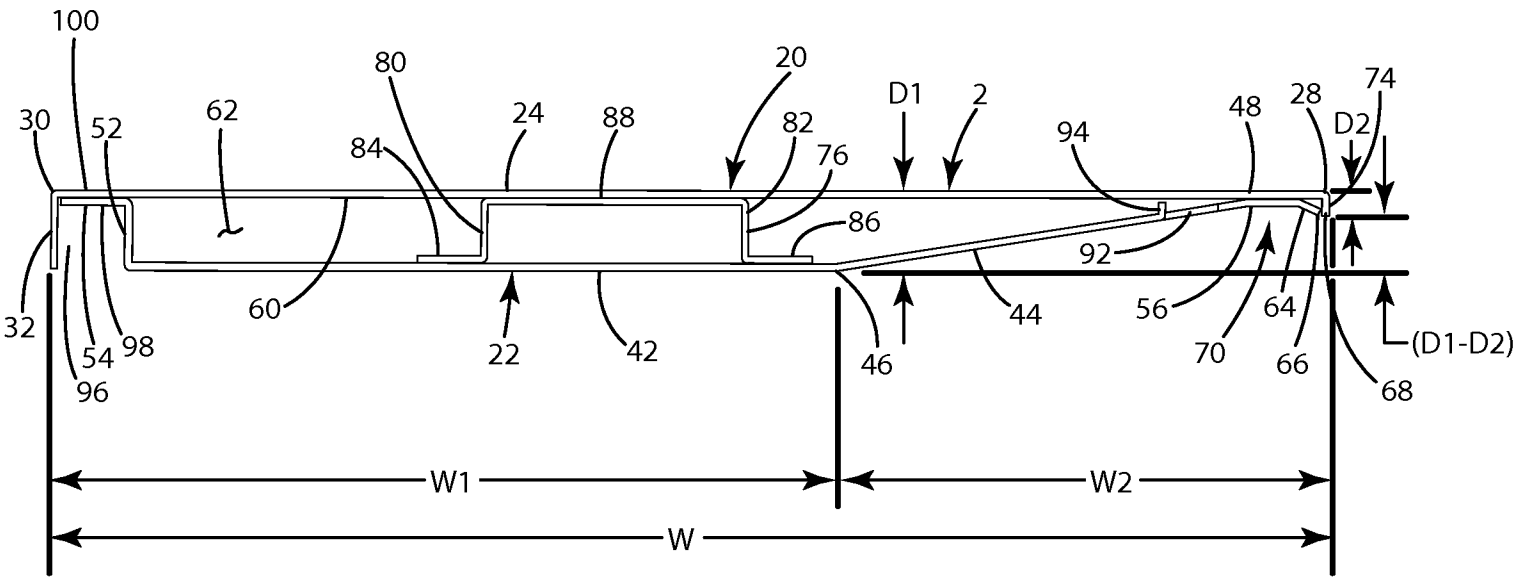
FIG. 5 is an end view of a shelf.
Figure 6:
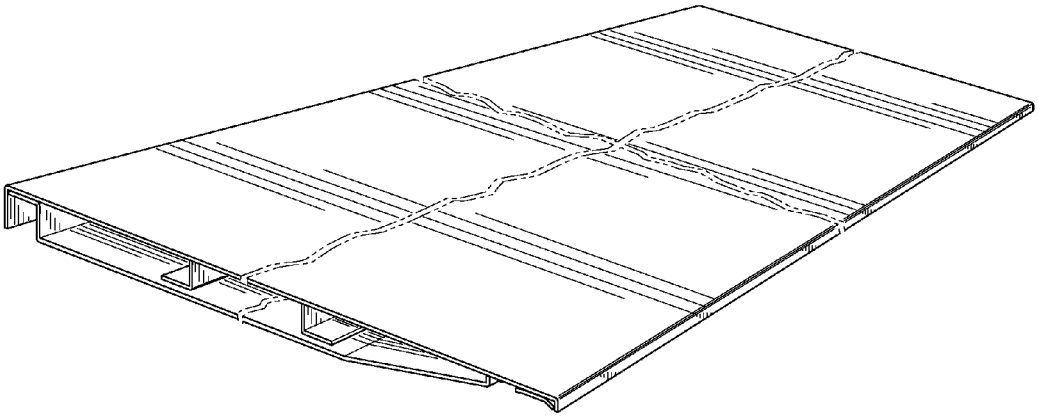
FIG. 6 is a fragmentary isometric view of a SHELF according to an aspect our new design showing the ornamental appearance thereof.
Figure 7:
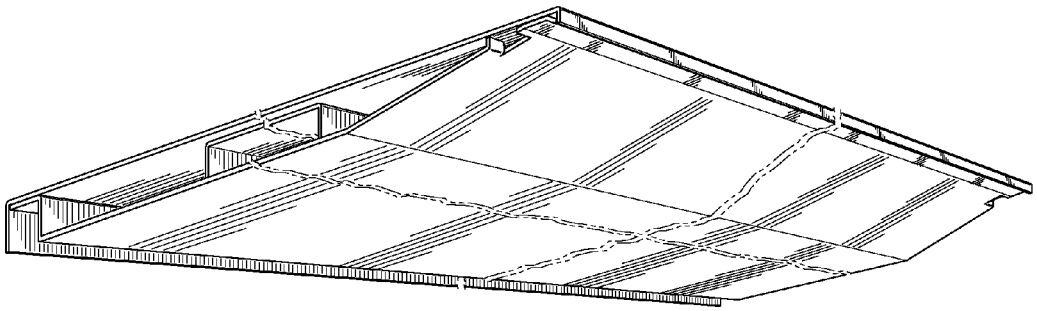
FIG. 7 is a fragmentary isometric view of the SHELF of FIG. 6.
Figure 8:
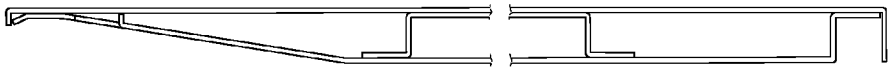
FIG. 8 is a fragmentary right-hand side elevational view of the SHELF of FIG. 6.
Figure 9:
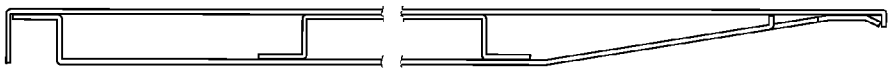
FIG. 9 is a fragmentary left-hand side elevational view of the SHELF of FIG. 6.
Figure 10:
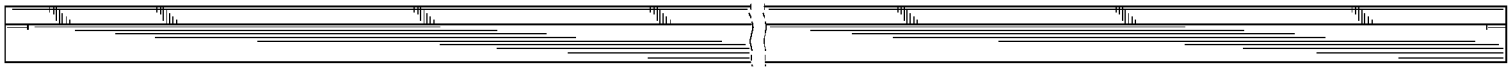
FIG. 10 is a fragmentary front elevational view of the SHELF of FIG. 6.
Figure 11:
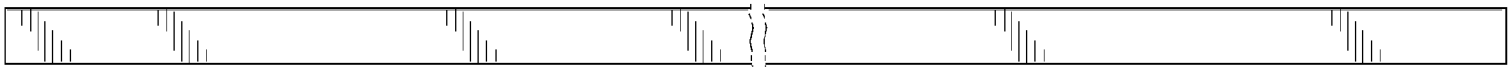
FIG. 11 is a fragmentary rear elevational view of the SHELF of FIG. 6.
Figure 12:
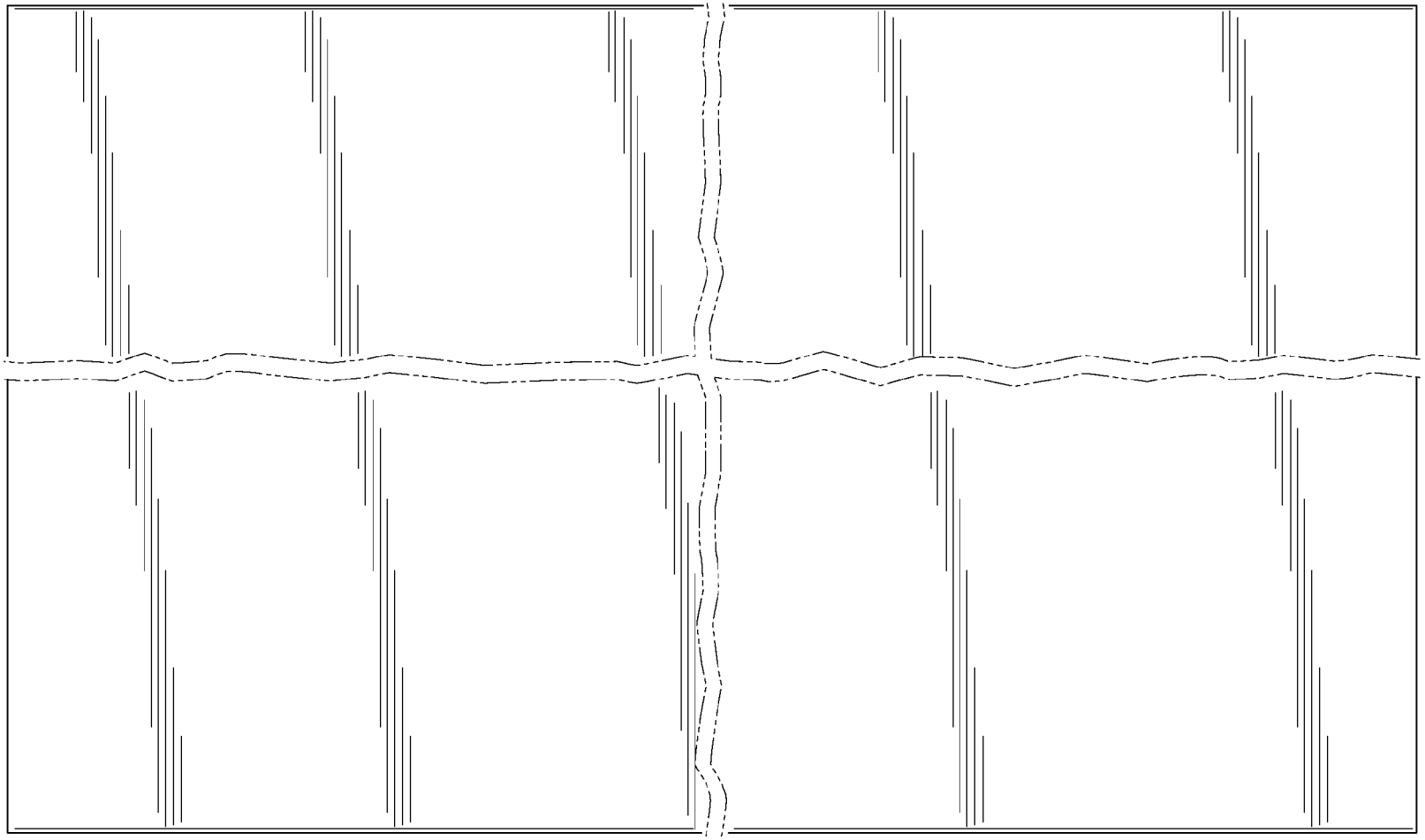
FIG. 12 is a fragmentary top plan view of the SHELF of FIG. 6.
Figure 13:
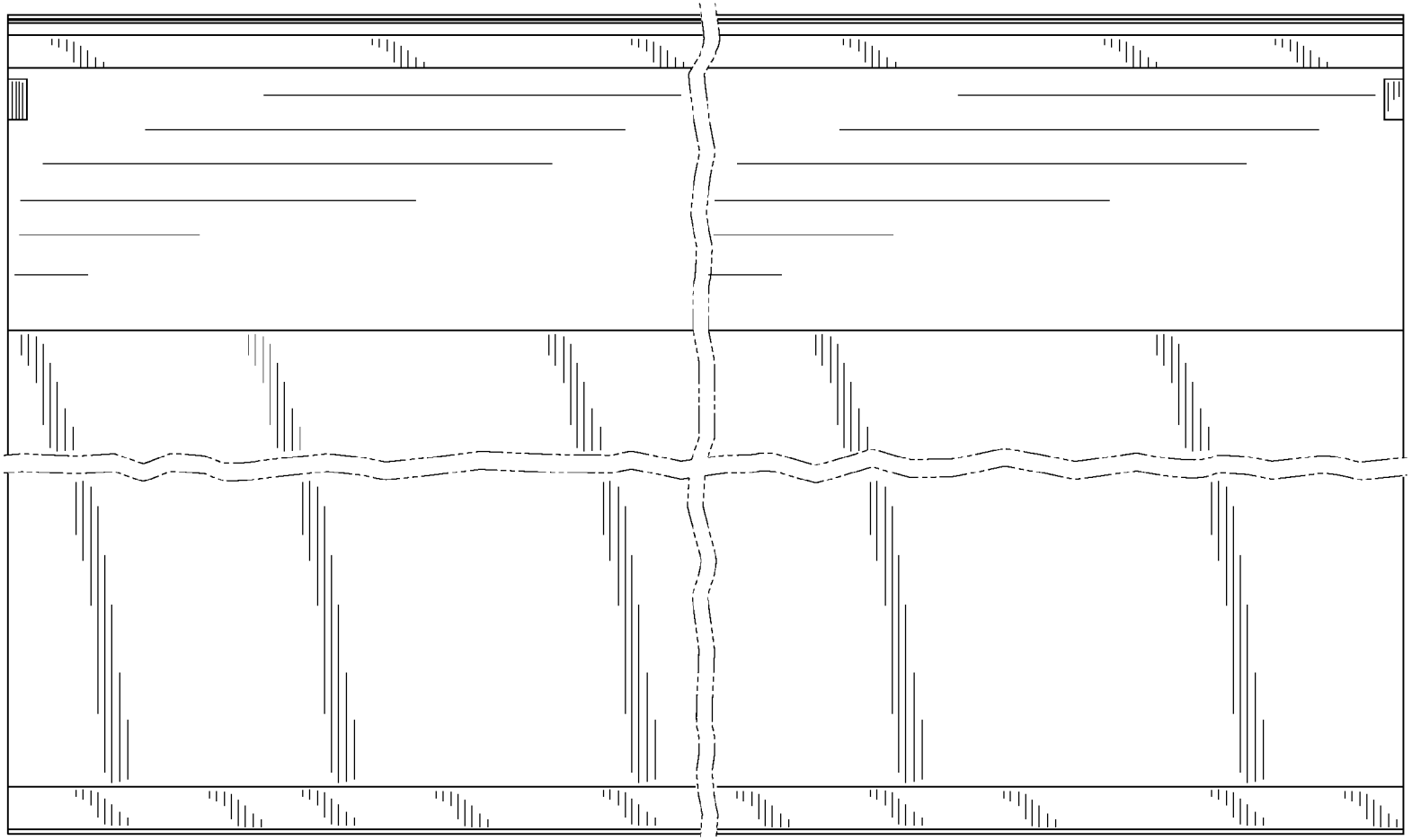
FIG. 13 is a fragmentary bottom plan view of the SHELF of FIG. 6.
Figure 14:
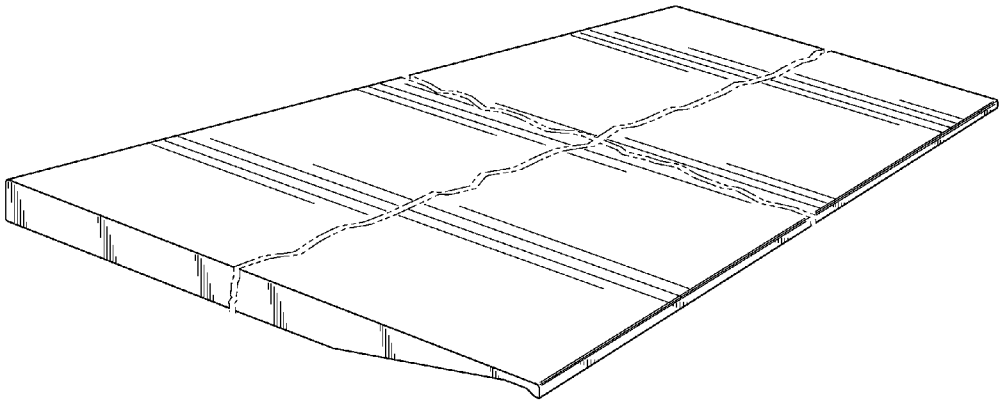
FIG. 14 is a fragmentary isometric view of a SHELF according to another aspect of our new design showing the ornamental appearance thereof.
Figure 15:
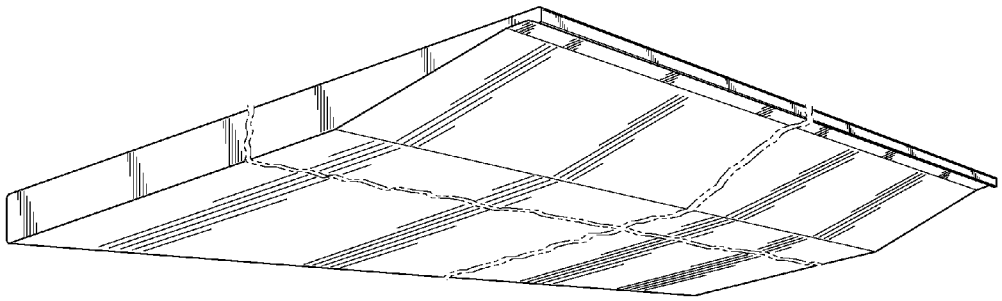
FIG. 15 is a fragmentary isometric view of the SHELF of FIG. 8.
Figure 16:
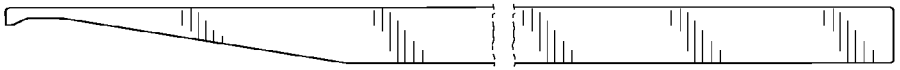
FIG. 16 is a right-hand side elevational view of the SHELF of FIG. 8.
Figure 17:
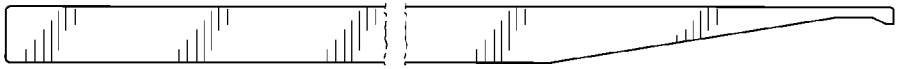
FIG. 17 is a left-hand side elevational view of the SHELF of FIG. 8.
Figure 18:
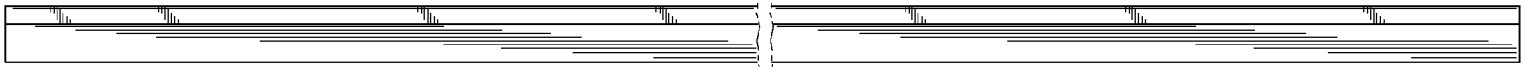
FIG. 18 is a fragmentary front elevational view of the SHELF of FIG. 8.
Figure 19:
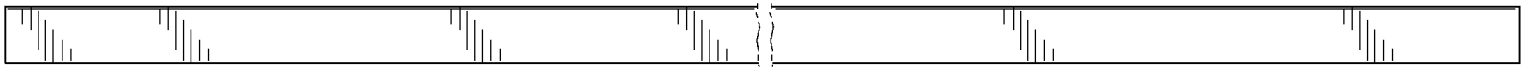
FIG. 19 is a fragmentary rear elevational view of the SHELF of FIG. 8.
Figure 20:
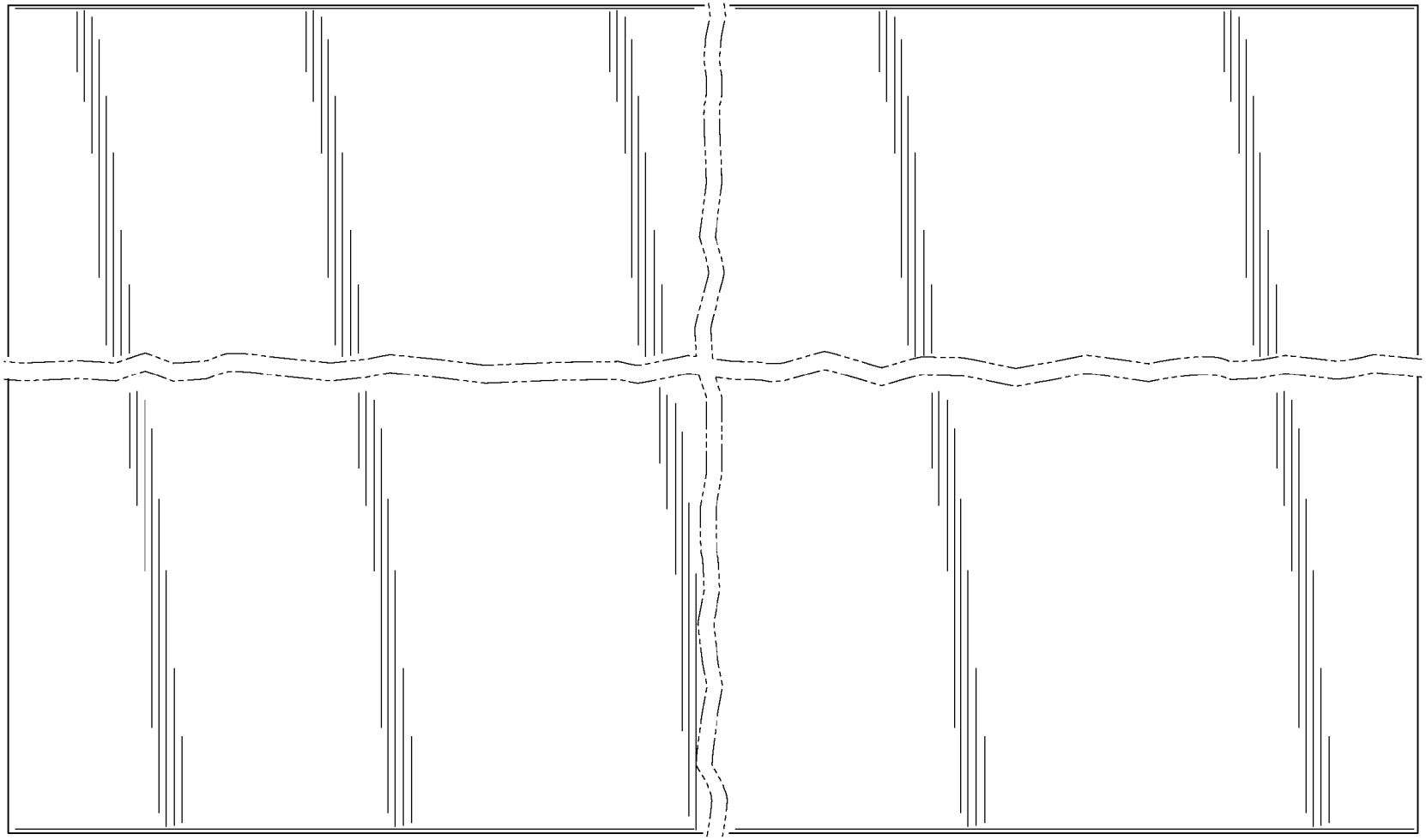
FIG. 20 is a fragmentary top plan view of the SHELF of FIG. 8.
Figure 21:
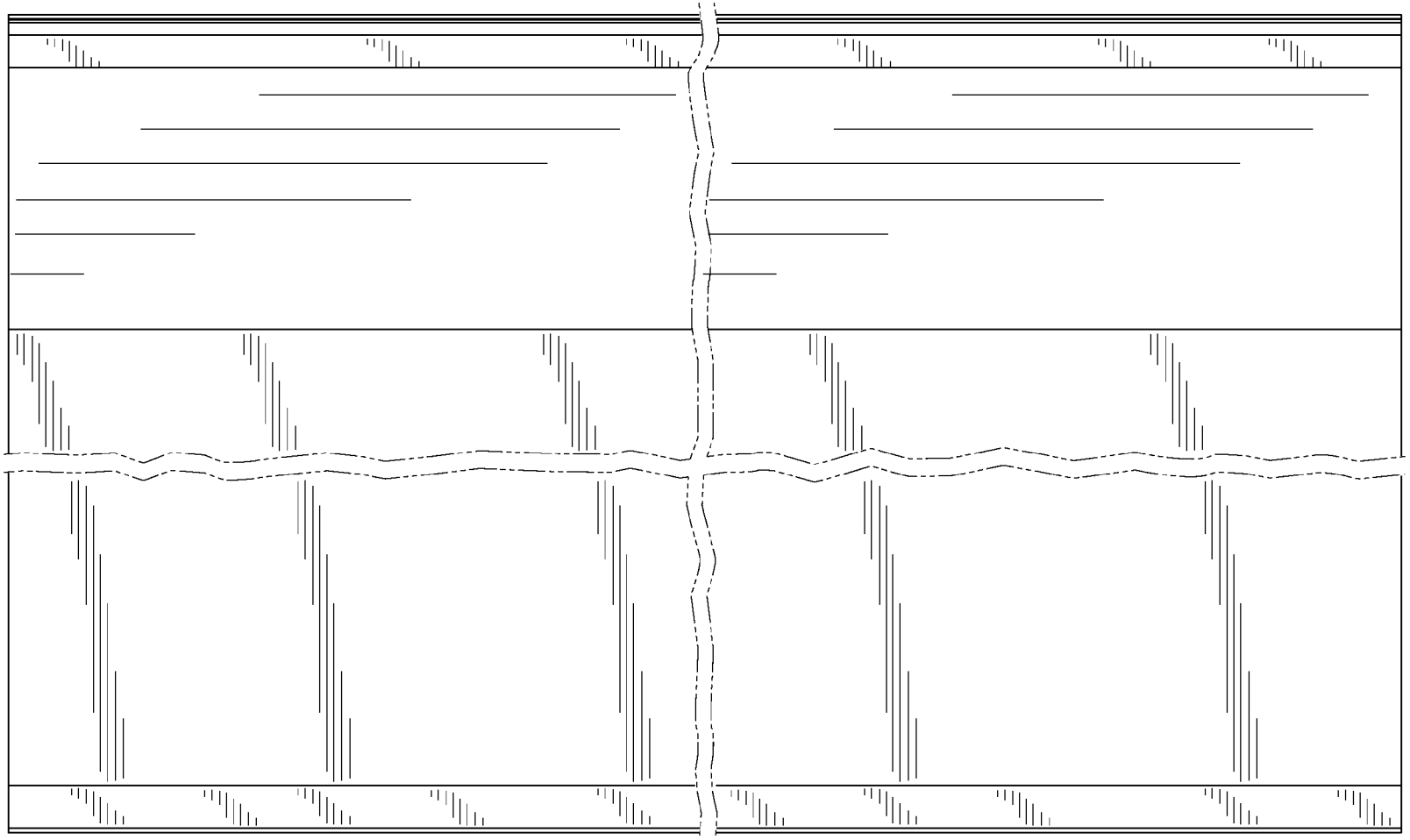
FIG. 21 is a fragmentary bottom plan view of the SHELF of FIG. 8.
Figure 22:
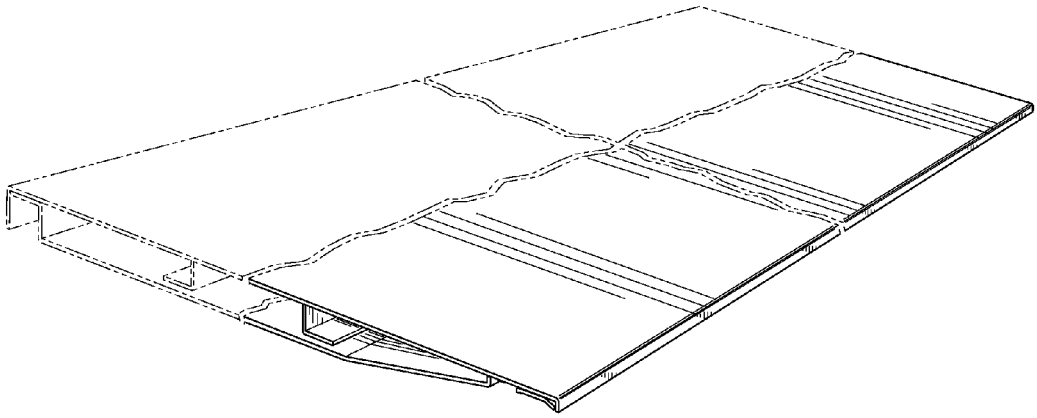
FIG. 22 is an isometric view of a SHELF according to another aspect of our new design showing the ornamental appearance thereof.
Figure 23:
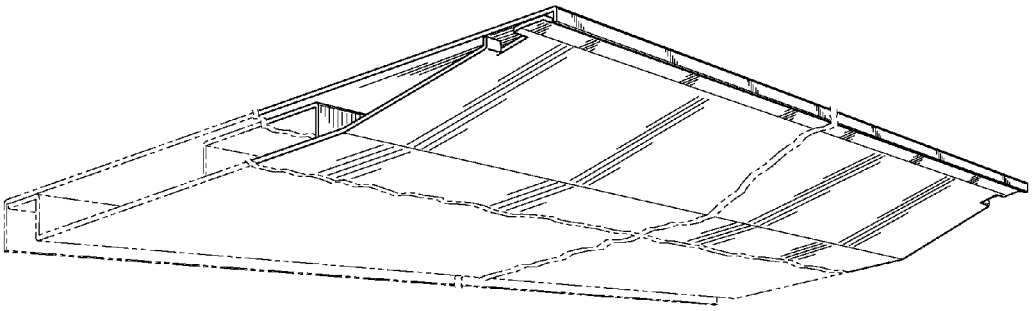
FIG. 23 is an isometric view of the SHELF of FIG. 22.
Figure 24:
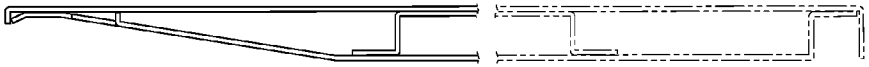
FIG. 24 is a right-hand side elevational view of the SHELF of FIG. 22.
Figure 25:
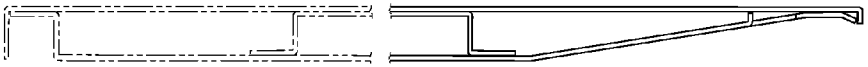
FIG. 25 is a left-hand side elevational view of the SHELF of FIG. 22.
Figure 26:
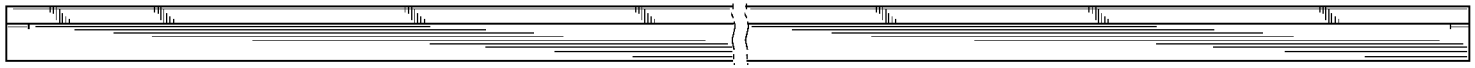
FIG. 26 is a front elevational view of the SHELF of FIG. 22.
Figure 27:
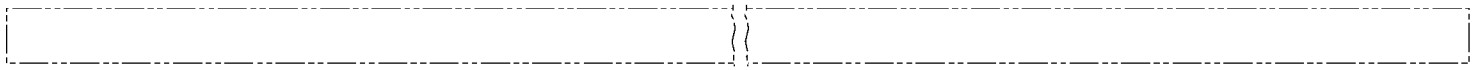
FIG. 27 is a rear elevational view of the SHELF of FIG. 22.
Figure 28:
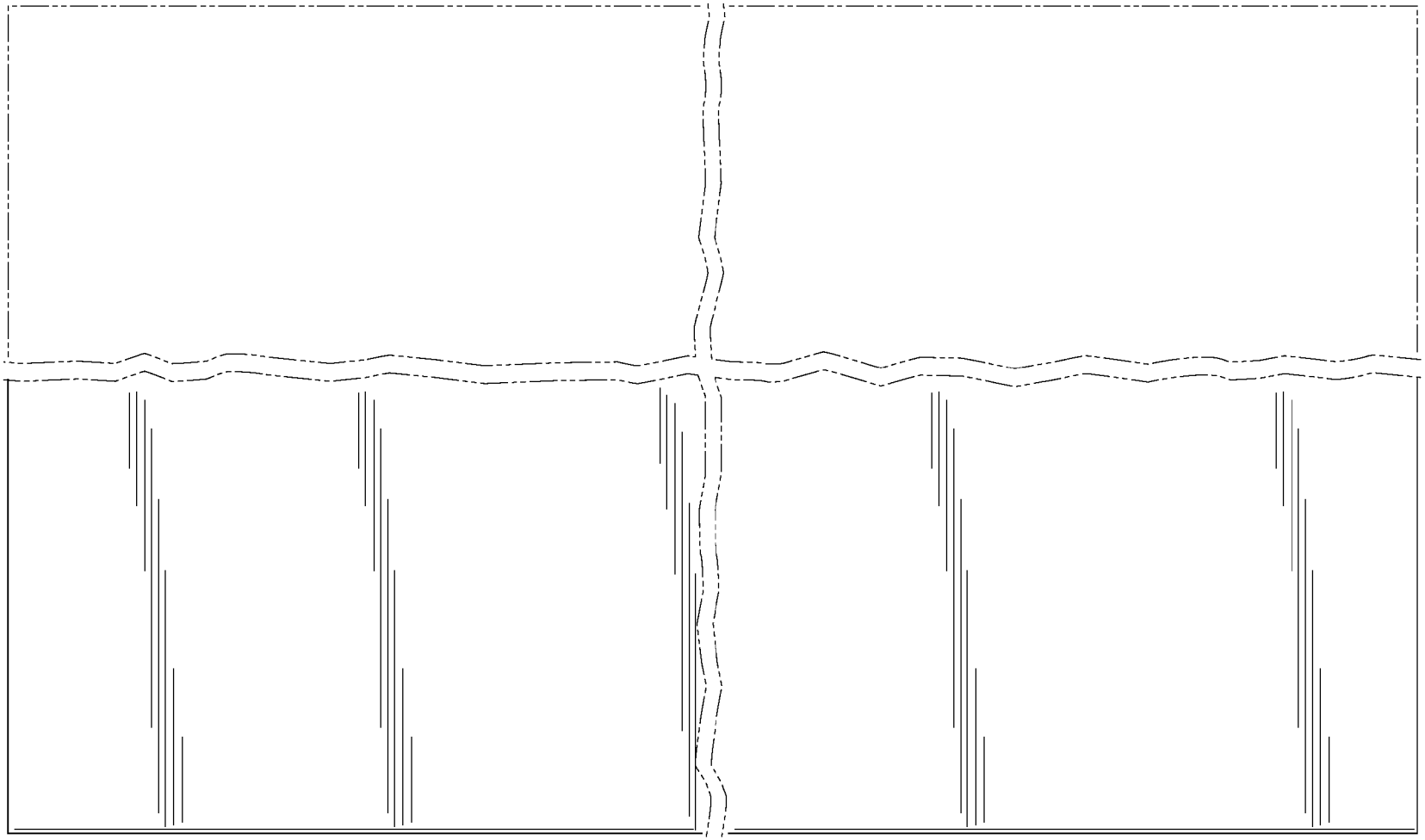
FIG. 28 is a top plan view of the SHELF of FIG. 22.
Figure 29:
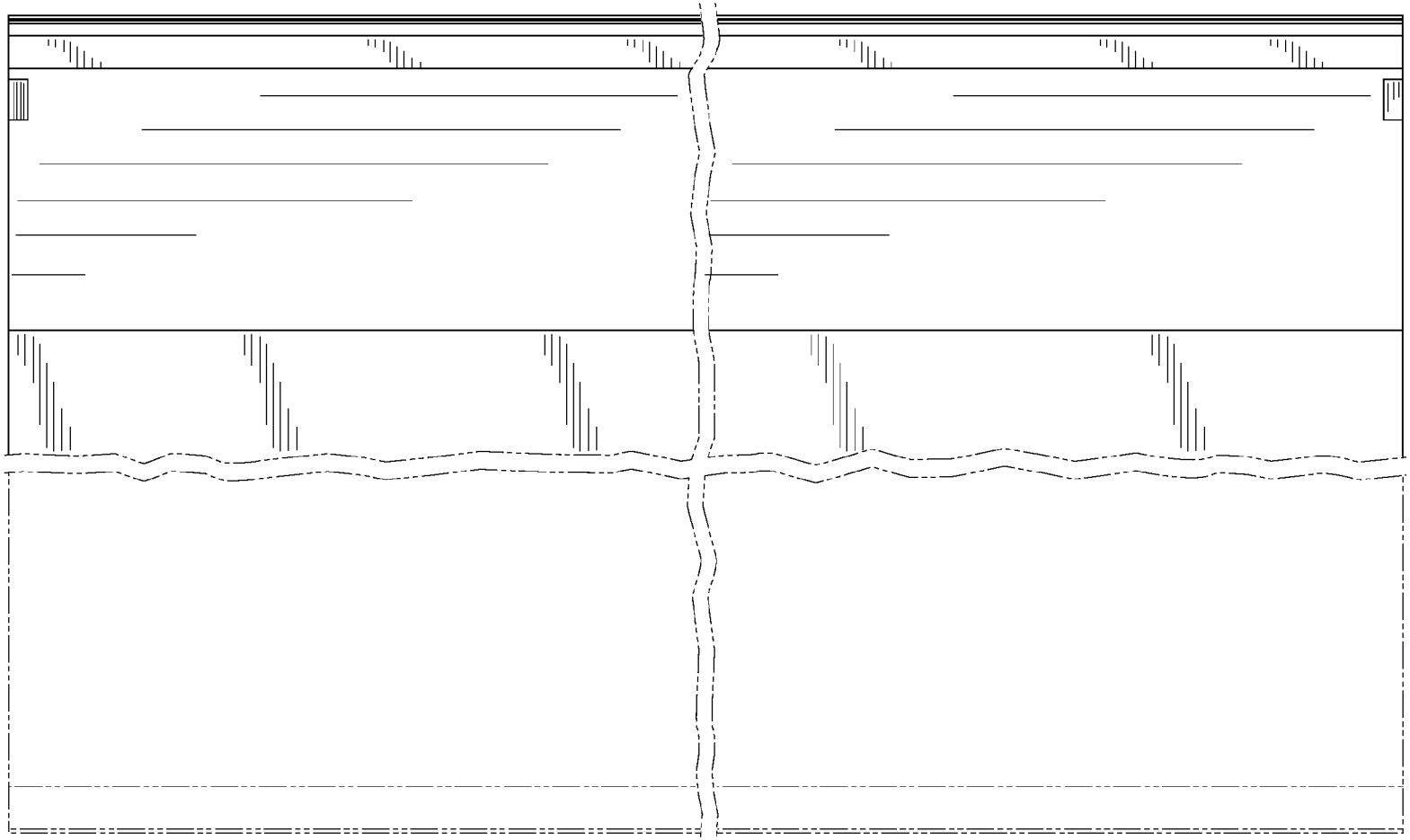
FIG. 29 is a bottom plan view of the SHELF of FIG. 22.
Figure 30:
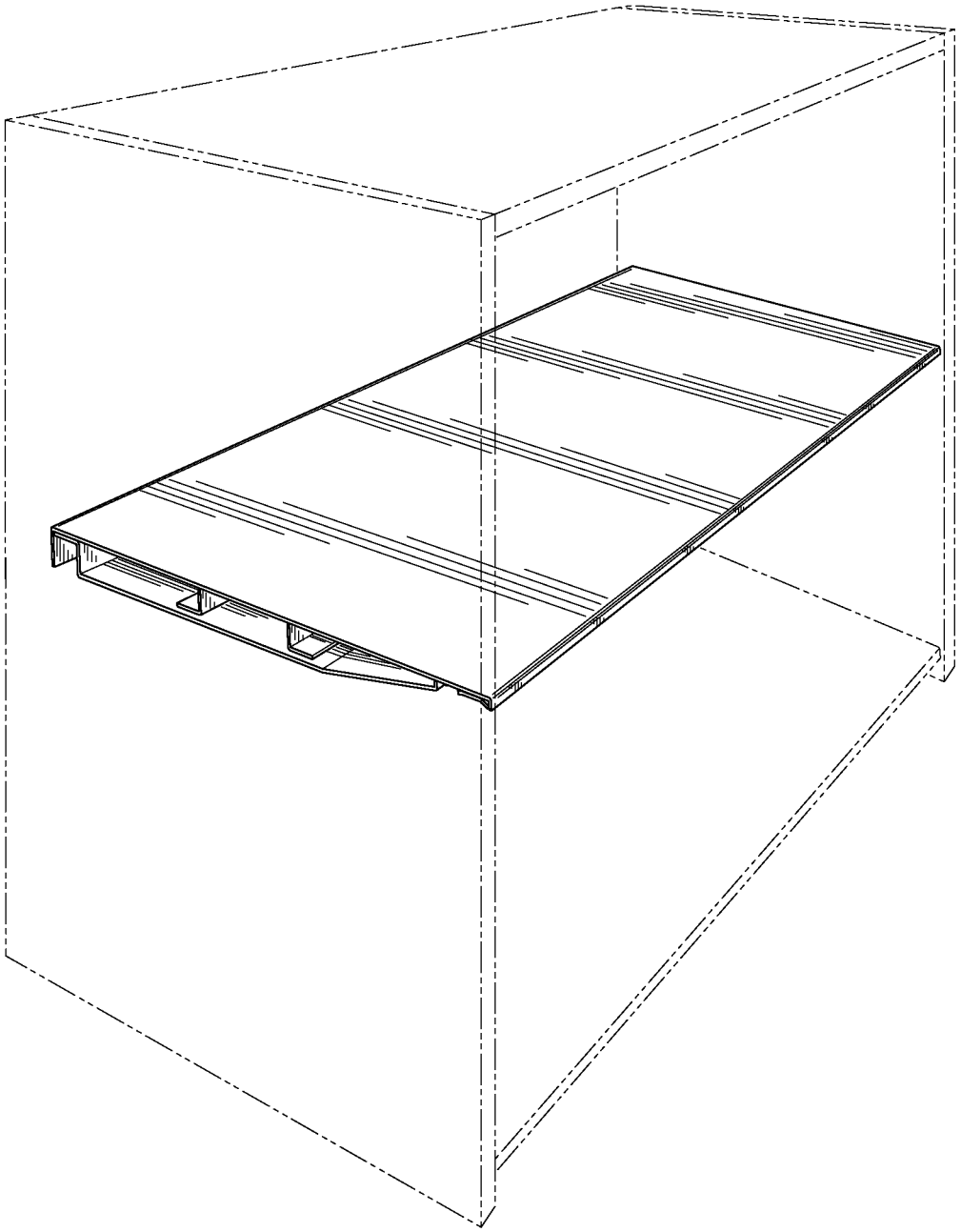
FIG. 30 is an isometric view of a SHELF according to another aspect of our new design showing the ornamental appearance thereof.
Figure 31:
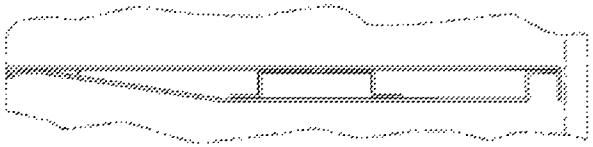
FIG. 31 is a right-hand side elevational view of the SHELF of FIG. 30.
Figure 32:
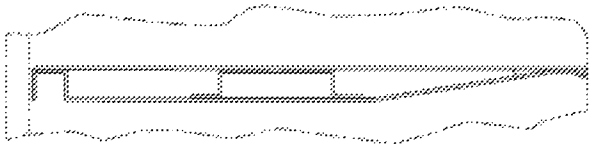
FIG. 32 is a left-hand side elevational view of the SHELF of FIG. 30.
Figure 33:
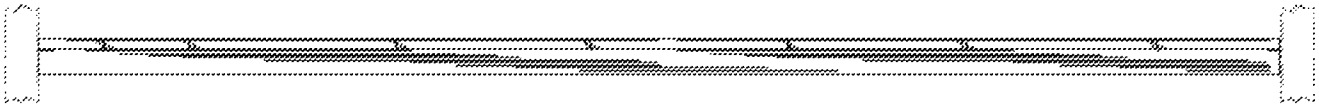
FIG. 33 is a front elevational view of the SHELF of FIG. 30.
Figure 34:
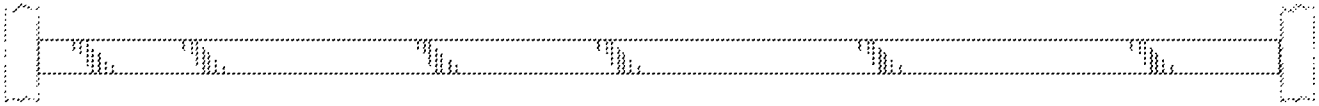
FIG. 34 is a rear elevational view of the SHELF of FIG. 30.
Figure 35:
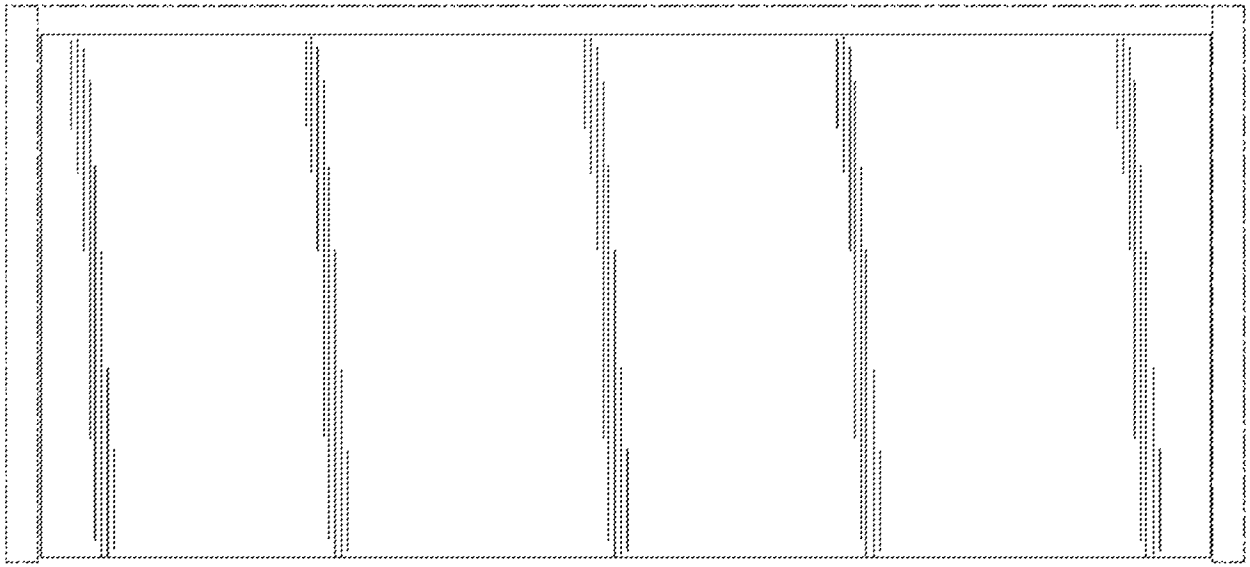
FIG. 35 is a top plan view of the SHELF of FIG. 30.
Figure 36:
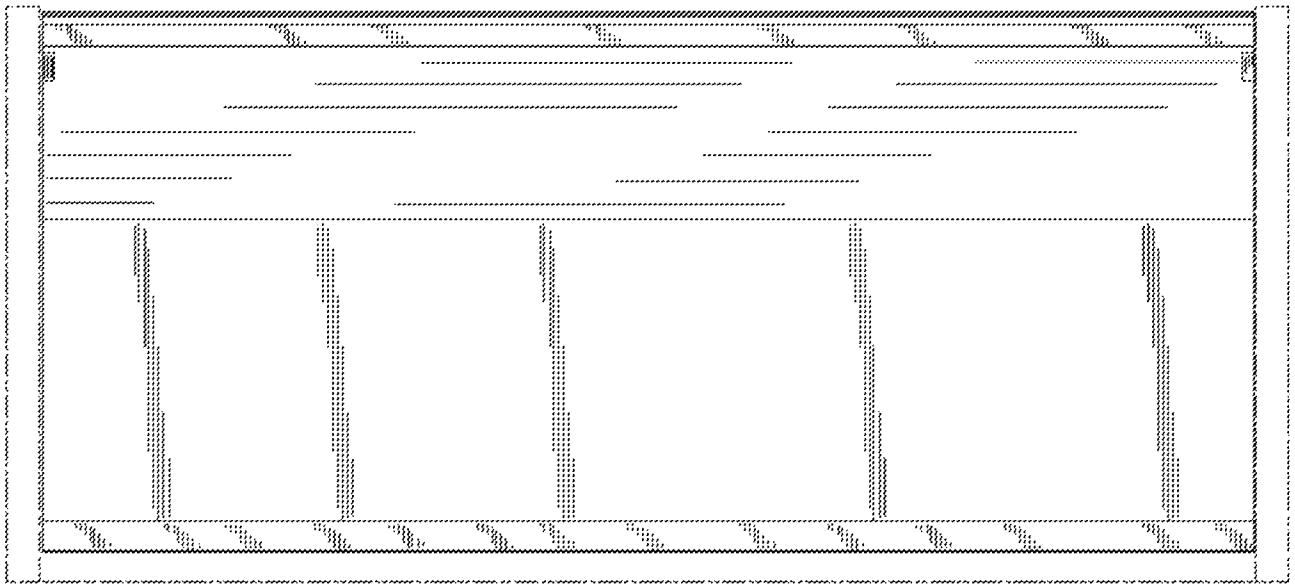
FIG. 36 is a bottom plan view of the SHELF of FIG. 30.

With further reference to FIG. 5, flange 34 defines a substantially planar vertical front surface 74. The planar upper surface 24 of upper member 20 and the planar rear surface 42 of lower member 22 are spaced apart to define a vertical dimension "D1." The front surface 74 defines a second vertical dimension "D2" that is significantly less than the first vertical dimension D1. In a preferred embodiment, the first vertical dimension D1 is about 0.75 inches, and the second vertical dimension D2 is about 0.16 inches. However, the shelf 2 may have other dimensions as required for a particular application. In general, the first dimension D1 is at least about twice as great as second dimension D2 (i.e. the second dimension D2 is preferably no greater than one half of the first dimension D1). More preferably, the vertical dimension D1 is at least about three times the second vertical dimension D2. However, the ratio of the first vertical dimension D1 to the second vertical dimension D2 may be substantially greater than 3 according to other aspects of the present invention. Also, it will be understood that the first vertical dimension D1 may be larger than 0.75 inches (e.g. 1.0 inches or larger), or the first vertical dimension D1 may be less than 0.75 inches (e.g. 0.50 inches or less).

Referring again to FIG. 5, the shelf 2 may have an overall depth "W" of about 14 or 15 inches. However, the depth W may be significantly larger or smaller than 14 or 15 inches. The distance "W1" between the rear flange 32 of shelf 2 and the intersection 46 between the planar rear portion 42 and angled front portion 44 of lower member 22 is preferably about two-thirds of the overall depth W. Thus, the ratio W1/W2 is preferably about 2.0. However, the ratio of W1/W2 may be significantly greater than 2.0, or the ratio may be significantly less than 2.0. In general, the dimension W2 is preferably at least about 2.0 inches, and more preferably at least about 4.0 inches. In a preferred embodiment, W2 is equal to about 5.5 inches. In general, a large dimension W2 will provide a thinner appearance which may be desirable. However, larger dimensions W2 may reduce the strength of shelf 2 along the front edge 28. The overall length "L" (FIG. 3) of the shelves 2 will vary as required, and is, in general, somewhat smaller than the internal dimensions between upright members 6.

The preferred dimensional characteristics to provide a visually thin appearance may also be defined utilizing a ratio of thickness to depth dimension W2. Specifically, the difference between D1 and D2 (i.e. D1−D2) divided by W2 is preferably about 1/10 (0.10) (i.e. (D1−D2)/W2=1/10). The ratio of D1−D2 to W2 (i.e. (D1−D2)/W2) is preferably in a range of about 1/12 to about 1/8. Thus, shelf 2 is preferably configured such that:

$$\frac{1}{12} < \frac{D1 - D2}{W2} < \frac{1}{8} \qquad 1.0$$

Although shelf 2 could be configured such that the dimensions D1, D2, and W2 do not satisfy the relationship specified in equation 1.0, shelf 2 is preferably configured to satisfy the relationship defined in equation 1.0 to provide a visually thin appearance.

Referring again to FIG. 3, shelf 2 may include an elongated reinforcing member 76. The reinforcing member 76 may comprise a hat channel having a generally planar horizontal upper web 78, vertical webs 80 and 82, and horizontal flanges 84 and 86. The flanges 84 and 86 may be spot welded to the lower member 22. Flange 86 is preferably positioned directly adjacent fold line or intersection 46. Hat channel 76 is preferably positioned as close to front edge 28 of shelf 2 as possible to provide increased bending strength along the front edge of shelf 2. When assembled, the upper surface 88 of horizontal upper web 78 is disposed directly adjacent (or abutting) lower surface 60 (see also FIG. 5) of upper member 20. The upper member 22 is preferably not welded to the reinforcing member 76 to avoid creating irregularities in the planar upper surface 24 of upper member 20. The reinforcing member 76 provides bending strength and stiffness to reduce bending of shelf 2 that could otherwise occur. Furthermore, the stiffness provided by the reinforcing member 76 permits the vertical dimension D1 (FIG. 5) to be minimized, thereby providing a shelf 2 having a relatively thin profile.

With further reference to FIG. 4, the opposite side edges 36A and 36B of lower member 22 may include cut out portions 92 that receive pins 18 when shelves 2 are installed between upright members 6. A flange 94 extends upwardly to provide a stop that engages pin 18 to prevent forward movement of shelf 2 unless the shelf 2 is lifted upwardly to disengage pin 18 from cut out area 92. When shelves 2 are supported on pins 18, the pins 18 contact lower surface 90 of upper member 20. The cut outs 92 form recesses or pockets that receive the pins 18 to reduce the visibility of the pins 18.

Referring again to FIG. 5, the flanges 52 and 54 of lower member 22, and the rear flange 32 of upper member 20 together define a rear channel 96 that opens downwardly. When shelf 2 is positioned on pins 18, a pair of the pins 18 contact lower surface 98 of flange 54 in rear channels 96 to thereby support a rear portion 100 of the shelf 2. The vertical position of the lower surface 54 relative to the planar upper surface 24 of upper member 20 is substantially the same as the lower surface 60 of upper member 20, such that the pins 18 support the shelves 2 in a substantially horizontal manner.

It is also to be understood that variations and modifications can be made on the aforementioned structures and methods without departing from the concepts of the present invention, and further it is to be understood that such concepts are intended to be covered by the following claims unless these claims by their language expressly state otherwise.

The invention claimed is:

1. A storage system comprising:

a pair of spaced apart upright panels having generally vertical inner sides that face one another;

at least two supports extending inwardly from each vertical inner side of the upright panels;

a shelf having opposite ends engaging the supports to support the shelf and front and rear edges wherein the shelf includes a planar horizontal upper surface and a lower surface having a planar horizontal rear portion and an opaque angled forward portion that extends forwardly and upwardly from the planar horizontal rear portion such that the shelf has a reduced thickness along the front edge of the planar horizontal upper surface, wherein the planar horizontal upper surface and the planar horizontal rear portion of the lower surface define a first vertical dimension, and wherein the shelf includes a generally front surface extending downwardly from the front edge of the planar horizontal upper surface, the front surface having upper and lower edges defining a second vertical dimension that is significantly smaller than the first dimension, and wherein, the angled forward portion of the lower surface and the planar horizontal rear portion of the lower surface intersect along an intersection line, and wherein the shelf defines a front horizontal width dimension between the intersection line and the front edge of the shelf and wherein a ratio of a difference between the first and second vertical dimensions to the front horizontal width is at least about 0.083, and less than about 0.125.

2. The storage unit of claim 1, wherein:

the lower surface of the shelf includes a downwardly facing front channel extending adjacent the front edge of the shelf.

3. The storage unit of claim 2, wherein:

the lower surface includes a downwardly facing rear channel extending adjacent the rear edge of the shelf.

4. The storage unit of claim 3, wherein:

the shelf includes upper and lower sheet metal components that are welded together to provide a generally tubular construction having an interior space between the upper and lower sheet metal components.

5. A storage system comprising:

a pair of spaced apart upright panels having generally vertical inner sides that face one another;

at least two supports extending inwardly from each vertical inner side of the upright panels;

a shelf having opposite end portions engaging the supports to support the shelf, the shelf comprising:

a sheet metal shelf structure having a generally tubular construction including an upper sheet metal portion having a generally planar horizontal portion defining front and rear edges, the shelf structure further including a lower sheet metal portion, front and rear portions interconnecting the upper and lower sheet portions to define an interior space, wherein the opposite end portions extend between front and rear corners of the shelf structure, each end portion including at least front and rear support features that are configured to engage supports extending from vertical support surfaces adjacent the opposite end portions of the shelf structure to support the shelf structure adjacent the front and rear corners thereof; and wherein:

the lower sheet metal portion includes a generally planar horizontal rear portion that is spaced apart from the planar horizontal upper sheet metal portion to define a substantially uniform vertical first dimension, the lower sheet metal portion further including a generally planar angled front portion that intersects the rear portion along an elongated intersection, the angled front portion extending forwardly and upwardly from the rear portion to the front portion of the shelf structure whereby a front portion of the shelf structure tapers to provide a significantly reduced vertical dimension at the front edge relative to the vertical first dimension, and wherein the shelf structure includes a front surface extending downwardly from the front edge, the front surface having upper and lower edges defining a second vertical dimension that is significantly smaller than the first dimension.

6. The storage system of claim 5, wherein:

the upper and lower sheet metal portions comprise separate pieces of metal sheet material that are welded together.

7. The storage system of claim 5, including:

an internal reinforcing member disposed in the interior space and extending between the opposite end portions to thereby provide increased bending strength.

8. The storage system of claim 5, wherein:

the lower sheet metal portion includes a substantially horizontal front flange extending forwardly from the front portion of the lower sheet, and wherein the horizontal front flange has a generally planar upper surface that abuts a lower surface of the upper sheet metal portion.

9. The storage system of claim 8, wherein:

the front flange of the lower sheet metal portion is welded to the upper sheet metal portion.

10. The storage system of claim 9, wherein:

the lower sheet metal portion includes an edge flange that extends forwardly and downwardly from along the front flange and defines a front edge that is vertically spaced apart from the planar portion of the upper sheet metal portion; and the upper sheet metal portion includes a downwardly extending front lip having a lower edge disposed directly adjacent the front edge of the front flange.

11. The storage system of claim 5, wherein:

the at least two supports of each upright panel includes a horizontal support; and the shelf structure defines a downwardly opening channel extending along a rear edge of the shelf structure, and wherein the downwardly opening channel has opposite ends that are open whereby the horizontal support can be positioned in the opposite ends of the channel to define rear support features.

12. The storage system of claim 11, wherein:

the lower sheet metal portion includes an upright rear flange extending upwardly from a rear edge of the lower sheet metal portion, and a horizontal flange extending from the upright rear flanges and abutting a lower surface of the planar portion of the upper sheet metal portion, and wherein the horizontal rear flange is welded to the upper sheet metal portion, the upper sheet portion further including a rear flange that extends downwardly adjacent an outer edge of the horizontal rear flange to define a rear surface of the downwardly opening channel.

13. A storage system comprising:

a pair of spaced apart upright panels having generally vertical inner sides that face one another;

at least two supports extending inwardly from each vertical inner side of the upright panels;

a shelf having opposite end portions engaging the supports to support the shelf, the shelf comprising:

a sheet metal shelf structure having a generally tubular construction including an upper sheet metal portion having a generally planar horizontal portion defining front and rear edges, the shelf structure further including a lower sheet metal portion, front and rear portions interconnecting the upper and lower sheet portions to define an interior space, wherein the opposite end portions extend between front and rear corners of the shelf structure, each end portion including at least front and rear support features that are configured to engage supports extending from vertical support surfaces adjacent the opposite end portions of the shelf structure to support the shelf structure adjacent the front and rear corners thereof; and wherein:

the lower sheet metal portion includes a generally planar horizontal rear portion that is spaced apart from the planar horizontal upper sheet metal portion to define a substantially uniform vertical first dimension, the lower sheet metal portion further including a generally planar angled front portion that intersects the rear portion along an elongated intersection, the angled front portion extending forwardly and upwardly from the rear portion to the front portion of the shelf structure whereby a front portion of the shelf structure tapers to provide a significantly reduced vertical dimension at the front edge portion relative to the vertical first dimension;

the upper and lower sheet metal portions comprise separate pieces of metal sheet material that are welded together;

an internal reinforcing member disposed in the interior space and extending between the opposite end portions to thereby provide increased bending strength; and wherein:

the internal reinforcing member comprises a metal channel that is welded to the lower sheet metal portion, but is not welded to the upper sheet metal portion.

14. The storage system of claim 13, wherein:

the internal reinforcing member includes an upper horizontal web abutting a lower surface of the upper sheet metal portion, a pair of vertical webs extending from the upper horizontal web, and front and rear horizontal lower flanges extending from the vertical webs, and wherein the lower flanges are welded to the lower sheet metal portion, and wherein the front flange defines a front edge extending along the elongated intersection between the horizontal rear portion of the lower sheet metal portion and the angled front portion of the lower sheet metal portion.

15. A storage system comprising:

a pair of spaced apart upright panels having generally vertical inner sides that face one another;

at least two supports extending inwardly from each vertical inner side of the upright panels;

a shelf having opposite end portions engaging the supports to support the shelf, the shelf comprising:

a sheet metal shelf structure having a generally tubular construction including an upper sheet metal portion having a generally planar horizontal portion defining front and rear edges, the shelf structure further including a lower sheet metal portion, front and rear portions interconnecting the upper and lower sheet portions to define an interior space, wherein the opposite end portions extend between front and rear corners of the shelf structure, each end portion including at least front and rear support features that are configured to engage supports extending from vertical support surfaces adjacent the opposite end portions of the shelf structure to support the shelf structure adjacent the front and rear corners thereof; and wherein:

the lower sheet metal portion includes a generally planar horizontal rear portion that is spaced apart from the planar horizontal upper sheet metal portion to define a substantially uniform vertical first dimension, the lower sheet metal portion further including a generally planar angled front portion that intersects the rear portion along an elongated intersection, the angled front portion extending forwardly and upwardly from the rear portion to the front portion of the shelf structure whereby a front portion of the shelf structure tapers to provide a significantly reduced vertical dimension at the front edge portion relative to the vertical first dimension;

the at least two supports of each upright panel includes a horizontal support and the angled front portion of the lower sheet metal portion includes opposite edges, and wherein each opposite edge includes at least one cut away portion defining a front support feature of the at least front and rear support features whereby the horizontal support can be positioned in each cut away portion in contact with a lower surface of the upper sheet metal portion to support the shelf structure.

16. A storage system comprising:

a pair of spaced apart upright panels having generally vertical inner sides that face one another;

at least two supports extending inwardly from each vertical inner side of the upright panels;

a shelf having opposite end portions engaging the at least two supports to support the shelf, the shelf comprising:

a generally planar top panel having a front edge, a rear edge, and side edges extending between the front and rear edges;

a bottom panel having a generally planar rear portion that is vertically spaced apart from the top panel to define a first vertical dimension, the bottom panel further including a generally planar angled front portion that extends forwardly and upwardly from the rear portion, wherein the angled front portion has a forward portion extending along the front edge of the top panel to define a front shelf edge having a second vertical dimension that is no greater than one half of the first vertical dimension and wherein:

each opposite end of the shelf includes at least two downwardly facing support surfaces that open outwardly away from the opposite end portions and receive the at least two supports extending from the spaced apart upright panels positioned adjacent the opposite end portions of the shelf to thereby support the shelf on the spaced apart upright panels.

17. The storage system of claim 16, wherein:

the top and bottom panels comprise sheet metal.

18. The storage system of claim 17, including:

a hat channel disposed between the top and bottom panels, wherein the hat channel includes a horizontal upper web abutting a lower surface of the top panel, the hat channel including a pair of lower flanges that are welded to the bottom panel, and wherein the hat channel is not welded to the upper panel.

19. The storage system of claim 17, wherein:

the top panel includes a downwardly extending vertical flange that forms the front shelf edge; and wherein:

the bottom panel includes a generally horizontal flange extending from the angled front portion, and an edge portion that extends downwardly and forwardly from the horizontal flange towards the vertical flange.

20. The storage system of claim 16, wherein:

the angled front portion of the bottom panel and the rear portion of the bottom panel intersect along an intersection line, and wherein the shelf defines a front horizontal width dimension between the intersection line and the front edge of the top panel, and wherein a ratio of a difference between the first and second vertical dimensions to the front horizontal width is at least about 0.083, and less than about 0.125.

21. A storage system comprising:

a pair of spaced apart upright panels having generally vertical inner sides that face one another;

at least two supports extending inwardly from each vertical inner side of the upright panels;

a shelf comprising a generally planar sheet metal top panel having a front edge, a rear edge, and side edges extending between the front and rear edges;

a sheet metal bottom panel having a generally planar rear portion that is vertically spaced apart from the top panel to define a first vertical dimension, the bottom panel further including an angled front portion that extends forwardly and upwardly from the rear portion along a junction wherein the angled front portion is joined to the top panel along the front edge thereof to define a front shelf edge having a second vertical dimension that is significantly smaller than the first vertical dimension; and:

a channel structure disposed between the top and bottom panels, wherein the channel structure is welded to the planar rear portion of the bottom panel, but not to the top panel, and wherein the channel structure includes an upper web that is directly adjacent a lower surface of the top panel, the channel including a lower front portion extending along the junction.

22. The shelf of claim 21, wherein:

the channel includes a pair of flanges that are welded to the bottom panel.

23. The shelf of claim 22, wherein:

the angled front portion of the bottom panel is substantially planar.

24. The shelf of claim 21, wherein:

the shelf includes opposite end portions engaging the spaced apart upright panels to support the shelf; and wherein:

each opposite end of the shelf includes at least two downwardly facing support surfaces that open outwardly away from the opposite end portions.

* * * * *